US012296277B2

(12) United States Patent
Liggett et al.

(10) Patent No.: US 12,296,277 B2
(45) **Date of Patent: *May 13, 2025**

(54) ZIP TRACK AND SYSTEM

(71) Applicant: JiMi IP, LLC, Allegan, MI (US)

(72) Inventors: James Allen Liggett, Allegan, MI (US); Troy Lee Garland, Allegan, MI (US); Timothy John Powers, Allegan, MI (US)

(73) Assignee: JiMi IP, LLC, Allegan, MI (US)

( * ) Notice: Subject to any disclaimer, the term of this patent is extended or adjusted under 35 U.S.C. 154(b) by 374 days.

This patent is subject to a terminal disclaimer.

(21) Appl. No.: 17/856,506

(22) Filed: Jul. 1, 2022

(65) Prior Publication Data

US 2023/0029168 A1 Jan. 26, 2023

Related U.S. Application Data

(63) Continuation of application No. 16/683,458, filed on Nov. 14, 2019, now Pat. No. 11,376,513, which is a continuation of application No. 16/282,647, filed on Feb. 22, 2019, now Pat. No. 10,478,737, which is a continuation of application No. 14/913,855, filed as application No. PCT/US2012/020850 on Jan. 11, 2012, now Pat. No. 10,213,699.

(60) Provisional application No. 61/476,344, filed on Apr. 18, 2011.

(51) Int. Cl.
*A63G 21/20* (2006.01)
*B61B 3/00* (2006.01)

(52) U.S. Cl.
CPC ..... *A63G 21/20* (2013.01); *B61B 3/00* (2013.01)

(58) Field of Classification Search
CPC ..... A63G 21/20; B61B 3/00
See application file for complete search history.

(56) References Cited

U.S. PATENT DOCUMENTS

| | | | |
|---|---|---|---|
| 9,702 | A | 5/1853 | Wilmot |
| 249,425 | A | 11/1881 | Walling |
| 291,014 | A | 12/1883 | Isard |
| 301,923 | A | 7/1884 | Reisdorff |
| 304,730 | A | 9/1884 | High |
| 308,444 | A | 11/1884 | Terwilliger |
| 316,969 | A | 5/1885 | High |
| 318,627 | A | 5/1885 | Keller |
| 371,483 | A | 10/1887 | Wakeman |

(Continued)

FOREIGN PATENT DOCUMENTS

| | | | | |
|---|---|---|---|---|
| AU | 2012246749 | A1 * | 10/2013 | ..... A63G 21/00 |
| AU | 2017206253 | A1 * | 8/2017 | ..... A63G 21/00 |

(Continued)

OTHER PUBLICATIONS

Ropes Courses, Inc., 2010 Product Catalog (published Nov. 1, 2010), 20 pages.
Ropes Courses, Inc., 2012 Product Catalog (published Nov. 1, 2012), 56 pages.

(Continued)

*Primary Examiner* — Jason C Smith
(74) *Attorney, Agent, or Firm* — Polson Intellectual Property Law P.C.; Margaret Polson; Christopher Sylvain

(57) ABSTRACT

A zip track system that is integrally connected to a challenge course so that a user can traverse one portion of the challenge course, and then can slide down the zip track system via a zip track to any other desired location.

20 Claims, 6 Drawing Sheets

(56) References Cited

U.S. PATENT DOCUMENTS 399,283 A 3/1889 Prittie
1,019,984 A 3/1912 McGee
1,087,062 A 2/1914 Izett
1,920,744 A 8/1933 Webb
2,365,117 A 12/1944 Stafford et al.
2,478,004 A 8/1949 Newell
2,589,803 A 3/1952 Haley
2,699,199 A 1/1955 Huntington
2,812,010 A 11/1957 Abdallah
3,039,401 A 6/1962 Bishop
3,040,678 A 6/1962 McEwen
3,270,441 A 9/1966 Hewes et al.
3,563,539 A 2/1971 Rogers et al.
3,577,930 A 5/1971 Rooklyn
3,860,089 A 1/1975 Huggett
3,875,866 A 4/1975 Mazuyer
4,062,293 A 12/1977 Davis
4,256,098 A 3/1981 Swan et al.
4,267,900 A 5/1981 Yin-Lung
4,401,033 A 8/1983 Gerken
4,464,997 A 8/1984 Dehne
4,592,686 A 6/1986 Andrews
4,597,689 A 7/1986 Mitchell et al.
4,705,422 A 11/1987 Tsui et al.
4,737,107 A 4/1988 Bories et al.
4,752,987 A 6/1988 Dreyer et al.
4,845,806 A 7/1989 Hamacher
4,911,426 A 3/1990 Scales
4,934,277 A 6/1990 Smith et al.
5,156,233 A 10/1992 Olsen et al.
5,271,481 A 12/1993 Rich
5,468,199 A 11/1995 Keeler et al.
5,647,747 A 7/1997 Macri et al.
5,660,113 A 8/1997 Lehotsky
5,667,461 A 9/1997 Hall
5,743,576 A 4/1998 Schron, Jr. et al.
5,885,189 A 3/1999 Lane et al.
5,890,328 A 4/1999 Gleave
5,924,260 A 7/1999 Austin et al.
5,931,100 A 8/1999 Sutton et al.
6,032,993 A 3/2000 Kwon
6,244,911 B1 6/2001 Bingham
6,269,944 B1 8/2001 Taylor
6,315,138 B1 11/2001 Dyson
6,374,456 B1 4/2002 Fort et al.
6,412,611 B1 7/2002 Pribonic
6,443,849 B1 9/2002 Byrd
6,604,605 B2 8/2003 Peterson et al.
6,622,634 B2 9/2003 Cylvick
6,666,773 B1 * 12/2003 Richardson ..... F16D 63/008 104/204
6,810,818 B2 11/2004 Petzl et al.
7,175,534 B2 * 2/2007 Liggett ..... A63G 31/02 472/136
7,381,137 B2 6/2008 Steele et al.
7,392,747 B2 * 7/2008 Ksyk ..... E05D 15/0608 104/111
7,416,054 B2 8/2008 Liggett
7,614,957 B2 11/2009 Lickle
7,966,941 B1 6/2011 Brannan
7,981,004 B2 7/2011 Liggett
7,992,680 B2 8/2011 Small
8,001,904 B2 8/2011 Maes et al.
8,016,686 B2 9/2011 Liggett
8,025,131 B1 9/2011 Boren
8,037,978 B1 * 10/2011 Boren ..... H02K 49/04 188/164
8,066,578 B2 * 11/2011 Liggett ..... A63G 31/02 472/136
8,286,559 B2 10/2012 Robinson et al.
8,360,937 B2 1/2013 Liggett
8,393,277 B2 * 3/2013 Johnston ..... B61B 3/02 104/238
8,683,925 B2 4/2014 Liggett
8,752,668 B2 * 6/2014 Liggett ..... A63B 9/00 182/36
8,783,190 B2 7/2014 Boren et al.
8,807,044 B2 * 8/2014 Liggett ..... B61B 12/00 105/155
8,807,292 B2 8/2014 Liston et al.
8,893,852 B2 11/2014 Liggett
8,960,098 B2 2/2015 Boren et al.
9,021,962 B2 5/2015 Hackett
9,033,115 B2 5/2015 Lerner
9,120,023 B1 * 9/2015 Burroughs ..... A63G 21/22
9,573,605 B2 2/2017 Steele et al.
9,707,976 B2 7/2017 Strasser
9,782,682 B2 * 10/2017 Frankowski ..... A63G 31/00
9,789,410 B2 * 10/2017 Dose ..... B61H 9/02
9,884,633 B2 * 2/2018 Horihan ..... B61B 7/00
9,932,046 B2 * 4/2018 Watermiller ..... A63G 7/00
10,016,634 B2 7/2018 Weston
10,093,328 B2 10/2018 Liggett
10,105,564 B2 10/2018 Garland
10,136,705 B2 11/2018 Liggett
10,207,137 B2 2/2019 Briggs
10,213,699 B2 * 2/2019 Liggett ..... A63G 21/20
10,220,859 B2 * 3/2019 Reese ..... A63G 9/04
10,478,737 B2 * 11/2019 Liggett ..... B61B 3/00
10,683,018 B2 * 6/2020 Horihan ..... B61B 3/00
10,814,149 B2 10/2020 Liggett
11,376,513 B2 * 7/2022 Liggett ..... B61B 3/00
11,400,383 B2 8/2022 Horihan
11,786,830 B2 10/2023 Horihan
2002/0162477 A1 * 11/2002 Palumbo ..... B61B 7/00 104/87
2004/0262103 A1 12/2004 Rosner
2006/0027134 A1 * 2/2006 Steele ..... B61B 12/06 104/113
2006/0090960 A1 * 5/2006 Liggett ..... A63G 33/00 182/36
2006/0252562 A1 11/2006 Anderson et al.
2006/0278478 A1 12/2006 Pribonic et al.
2009/0014259 A1 1/2009 Cylvick
2009/0049946 A1 2/2009 Buckman
2009/0065300 A1 * 3/2009 Liggett ..... A63B 17/00 182/36
2009/0078148 A1 * 3/2009 Cylvick ..... A63G 7/00 104/53
2009/0255436 A1 * 10/2009 Buckman ..... B60T 11/046 104/117.1
2009/0266267 A1 * 10/2009 Moss ..... A63G 21/20 104/53
2010/0078262 A1 4/2010 Townend et al.
2011/0132224 A1 * 6/2011 Kitchen ..... A63G 21/22 104/53
2011/0162917 A1 * 7/2011 Steele ..... B61H 9/02 188/65.1
2011/0239895 A1 * 10/2011 Liggett ..... B61B 7/00 105/148
2012/0083350 A1 * 4/2012 Frankowski ..... A63G 31/00 472/128
2012/0145498 A1 * 6/2012 Liston ..... B61H 9/02 188/378
2013/0118842 A1 * 5/2013 Lerner ..... B61H 9/02 188/62
2013/0228092 A1 * 9/2013 Liggett ..... A63B 9/00 104/140
2013/0239841 A1 9/2013 Boren
2013/0239842 A1 * 9/2013 Boren ..... B61B 7/00 188/62
2013/0239843 A1 * 9/2013 Boren ..... B61B 12/00 104/117.1
2014/0150685 A1 6/2014 Checketts
2015/0114250 A1 4/2015 Watermiller et al.
2015/0141205 A1 5/2015 Garland
2016/0272225 A1 * 9/2016 Liggett ..... B61B 3/00
2016/0319492 A1 * 11/2016 Horihan ..... A63G 31/00
2017/0036123 A1 * 2/2017 Liggett ..... B61B 3/00
2017/0088150 A1 3/2017 Christinet
2017/0259181 A1 9/2017 Cylvick
2019/0109528 A1 * 4/2019 Lerner ..... A63G 21/22

(56) References Cited

U.S. PATENT DOCUMENTS

| | | | | |
|---|---|---|---|---|
| 2019/0143156 | A1* | 5/2019 | Weston | A62B 35/0062 104/91 |
| 2019/0184296 | A1* | 6/2019 | Liggett | A63G 21/20 |
| 2020/0147503 | A1* | 5/2020 | Liggett | B61B 3/00 |
| 2021/0016116 | A1* | 1/2021 | Liggett | A63G 21/22 |
| 2023/0029168 | A1* | 1/2023 | Liggett | A63G 21/20 |
| 2024/0108992 | A1 | 4/2024 | Horihan | |

FOREIGN PATENT DOCUMENTS

| | | | | |
|---|---|---|---|---|
| DE | 102008006611 | B3 | 6/2009 | |
| DE | 112012001743 | T5 * | 2/2014 | A63G 21/00 |
| DE | 112012001743 | B4 * | 2/2020 | A63G 21/00 |
| WO | WO-2012145045 | A1 * | 10/2012 | A63G 21/00 |
| WO | WO-2018158463 | A1 * | 9/2018 | A63G 21/22 |

OTHER PUBLICATIONS

Ropes Courses, Inc., 2014 Product Catalog (published Nov. 1, 2014), 56 pages.
Ropes Courses, Inc., 2015 Product Catalog (publishedFeb. 1, 2015), 60 pages.
Ropes Courses, Inc., 2016 Product Catalog (published Aug. 1, 2016), 72 pages.
Ropes Courses, Inc., 2017 Product Catalog (published Aug. 1, 2017), 48 pages.
Walltopia, "Product Catalogue" (retrieved Mar. 24, 2017), 104 pages.
Walltopia, "Adventure" Project Guide (retrieved Mar. 24, 2017), 119 pages.
Walltopia, "Ropetopia" Brochure (retrieved Nov. 1, 2017), 8 pages.
Kristallturm, "High Rope Courses" Brochure (retrieved Nov. 1, 2017), 66 pages.

* cited by examiner

Section A-A

ZIP TRACK AND SYSTEM

RELATED APPLICATIONS

This application is a continuation of U.S. application Ser. No. 16/683,458 filed 14 Nov. 2019, which is a continuation of U.S. application Ser. No. 16/282,647 filed 22 Feb. 2019, which is a continuation of U.S. application Ser. No. 14/913,855 filed 18 Oct. 2016, which is a national stage entry of international application number PCT/US2012/020850 filed 11 Jan. 2012, which claims priority from U.S. provisional application No. 61/476,344 filed 18 Apr. 2011 titled ZIP TRACK AND SYSTEM.

FIELD OF THE INVENTION

This invention relates to an apparatus that allows a user to move or be displaced from one location to another along a track, using primarily gravity as the impetus.

BACKGROUND OF THE INVENTION

Challenge courses are structures that allow a person or team to challenge themselves by participating in various events, such as walking along swinging ropes or planks, at elevated heights. These courses are also used to train military personnel. These courses are also used at recreational parks or other such centers that have go-carts and miniature golf.

Zip lines are generally ropes or cables that are connected at both ends to fixed members of varying heights. In other words, one end is higher than the other. A participant then, by use of a pulley that rotatably engages with the rope or cable, glides from the higher end to the lower end.

The present invention is a zip track and system that allows a user to move or displace from one location to another without effort on the user's part. This movement or displacement may be performed primarily by the force of gravity. This differs from the prior art in that it may be integrally connected to a challenge course, or it may be a stand-alone system. The present invention also, rather than using cables or ropes, uses a fixed member, such as a beam or track along which the user is displaced via a glide or wheeled structure that glides or rolls within the beam or track.

There exists a need for a zip track system that enables a user to traverse from a challenge course to a zip track or from the zip track to a challenge course without disengaging from the glide or wheeled structure. This allows the user to travel at higher speeds than a zip line using a rope or cable due to the sagging that must occur in the rope or cable zip line. The present invention also allows for safer and more expedient movement throughout the course because the user can stay engaged in the same glide structure or wheeled structure throughout the system.

There also exists the need to increase the safety while not decreasing the capacity of participants traversing the challenge course.

Multiple embodiments of the system are disclosed herein. It will be understood that other objects and purposes of the invention, and variations thereof, will be apparent upon reading the following specification and inspecting the accompanying drawings.

REFERENCE NUMERALS LIST

10 zip track system
20 zip track

40 wheel support
50 plate
80 other portions of challenge course
90 rotating member
100 body/member
110 frame
120 fastener
125 fastener
130 zip track opening
160 challenge course
165 structure
170 platform
180 support means
190 lower end
200 higher end
210 support beam
220 trestle
230 truss
240 downward-upward curved portion
250 leftward-rightward curved portion
260 puck track
270 puck
280 body member
290 lanyard
295 safety harness
300 puck track opening
310 axle
320 vertical distance
330 puck support
340 exchange
350 entrance zone
360 one way gate/backstop
370 exit door
380 path
390 fixed side
400 intersection
410 exit path
420 braking means
430 magnet
440 circular shaped surface

SUMMARY OF THE INVENTION

One aspect of the present invention is a zip track system 10, comprising: a zip track 20 connected at one to a structure, and at another end, to another structure; a member 100 that is movably disposed within said zip track 20; whereby said member 100 is also movably disposed within a challenge course 160 integrally connected to said zip track 20.

Another aspect of the present invention is more than one zip track 20 connected to a structure; a support beam 210 connected to a zip track 20 at intervals of 20 feet or more to support said zip track 20; a support means 180 used to support said zip track 20; a trestle used to support said zip track 20; said support means 180 is a truss to support said zip track 20; wherein said zip track 20 has a non-linear slope; wherein said zip track 20 curves at least one of either leftwardly or rightwardly; wherein said challenge course 160 has a zip track 20 above an element of said challenge course 160; wherein said challenge course 160 has a zip track 20 descending from one level of elements to another level of elements; wherein said challenge course 160 has a zip track 20 that descends from the challenge course 160 to ground level; said member 100 having a puck 270 thereon, said puck 270 slidably disposed within a puck track 260; said member 100 having a rotating member 90 rotatably disposed on said member 100; said member 100 having a rotating member 90 rotatably disposed on said member 100 downwardly from said puck 270; a wheel support 40 integral with said zip track 20 whereby said rotating member 90 can roll on said wheel support 40; a puck support 330 that a puck 270 may slide above, and a wheel support 40 that a rotating member 90 may roll upon, whereby a vertical distance 320 between said puck support 330 and said wheel support 40 may increase such that said puck 270 is in frictional contact with said puck support 330 and said rotating member 90 is not contacting said wheel support 40; an entrance zone 350 that directs the member 100 toward an intersection 400 and said member 100 may move from said entrance zone 350 to said intersection 400 via a one way gate 360, said member 100 may then be able to move away from said intersection to at least one of either a challenge course 160 or an exit door 370; a braking means 420 to control the speed of a member 100 that is descending on a zip track 20; wherein said braking means 420 is at least one magnet 430 operably disposed to react to the member 100 to not allow the member 100 to approach a predetermined speed; wherein said magnet 430 is disposed in at least one of either a wheel support 40 or below said wheel support.

These and other features, aspects and advantages of the present invention will become better understood with reference to the following drawings, description and claims.

DETAILED DESCRIPTION OF THE INVENTION

Figure 1:
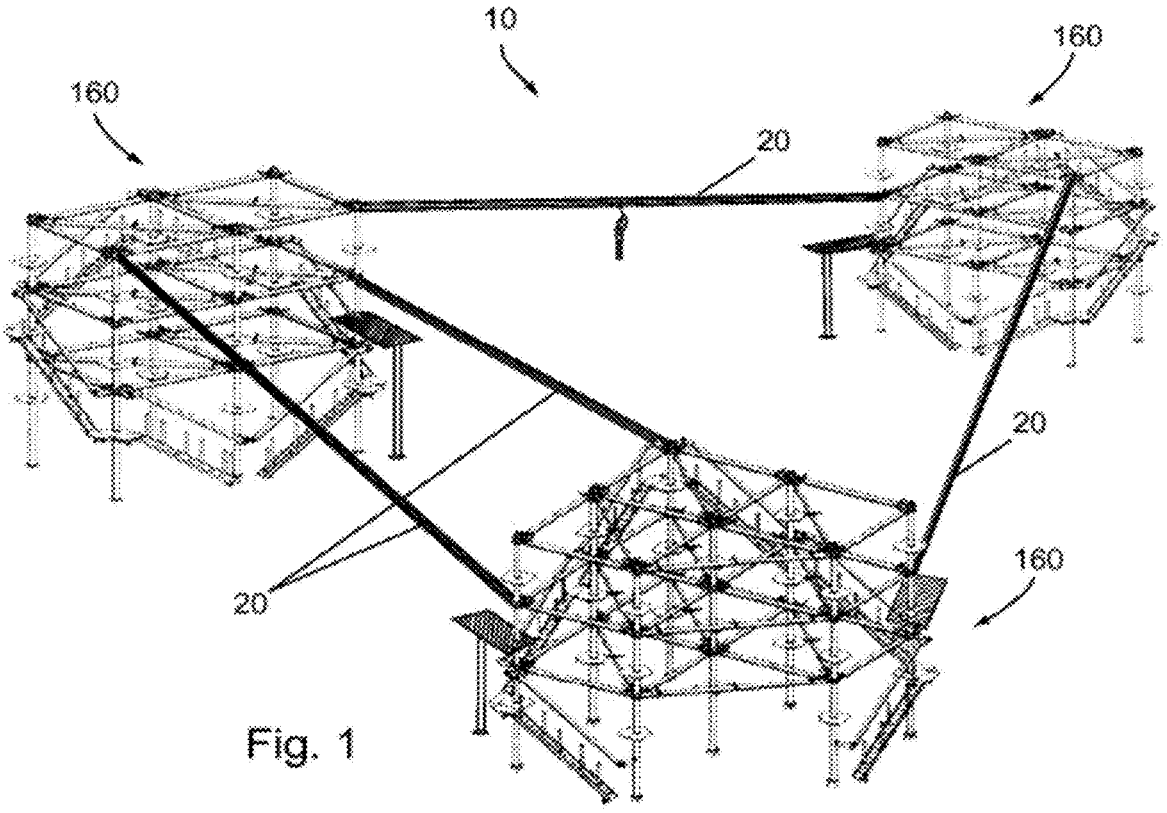
FIG. 1 is a pictorial view of one embodiment of the present invention of three challenge courses or towers connected with zip tracks.

The following detailed description is of the best currently contemplated modes of carrying out the invention. The description is not to be taken in a limiting sense, but is made merely for the purpose of illustrating the general principles of the invention, since the scope of the invention is best defined by the appended claims.

Certain terminology will be used in the following description for convenience and reference only, and will not be limiting. For example, the words "upwardly," "downwardly," "rightwardly," and "leftwardly" will refer to directions in the drawings to which reference is made. The words "inwardly" and "outwardly" will refer to directions toward and away from, respectively, the geometric center of the system and designated parts. Said terminology will include the words specifically mentioned, derivatives, and similar words. Also, "connected to," "secured to," or similar language includes the definitions "indirectly connected to," "directly connected to," "indirectly secured to," and "directly secured to."

FIG. 1 illustrates one embodiment of the present invention 10. FIG. 1 illustrates three different challenge courses 160 having a zip track 20 connected to each of the challenge courses 160. Alternatively, any end of a zip track may be connected to a tower. A tower or challenge course 160 may be referred to herein as a structure 165.

Figure 2:
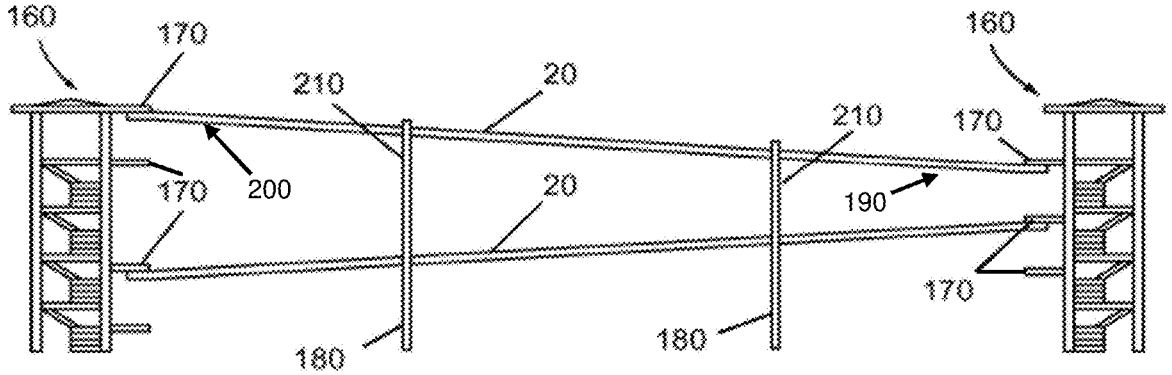
FIG. 2 is a pictorial side view of one embodiment of the present invention of the zip track connected to towers or portions of a challenge course.

FIG. 2 illustrates an embodiment having a zip track 20 connected to a platform 170 of the challenge course 160. The zip track 20 can be configured so that it has a lower end 190 connected to one challenge course 160 or platform 170, and a higher end 200 connected to another challenge course 160 or another platform 170, which allows gravity to be the impetus or force to assist in moving the user from the higher end 200 to the lower end 190.

Figure 3:
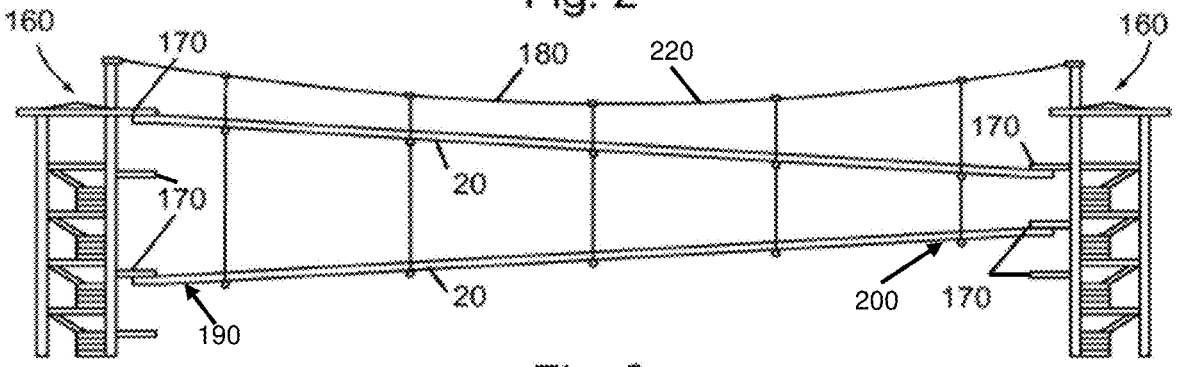
FIG. 3 is a pictorial side view of one embodiment of the present invention of the zip track connected to towers or portions of a challenge course.

As illustrated in FIG. 2, the zip track 20 may have a support means 180 to help support the zip track 20. As illustrated in FIG. 2, the support means 180 may be a support beam 210. Or as illustrated in FIG. 3, the support means 180 may be a trestle 220. As further illustrated in FIGS. 2 and 3 are two zip tracks 20 connected to two challenge courses 160, one zip track 20 is descending from left to right, and the other is ascending from left to right. There can of course be more than two zip tracks 20 going from one challenge course 160 or platform 170 to another challenge course 160 or another platform 170.

Figure 4:
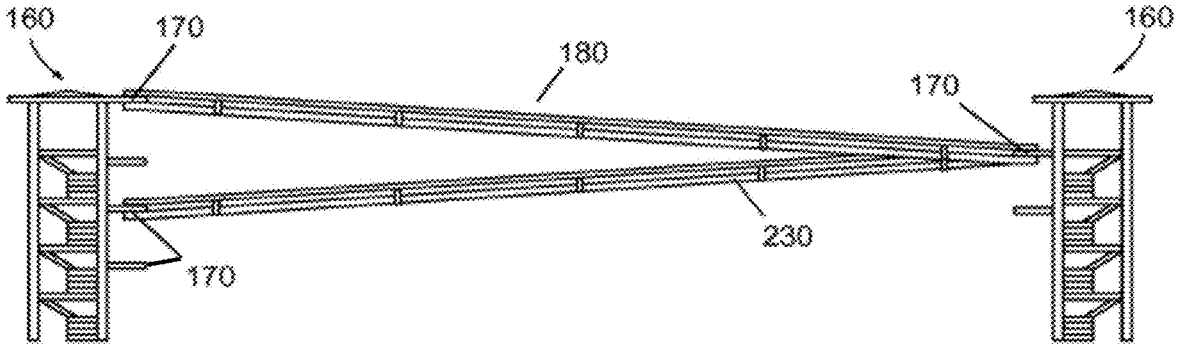
FIG. 4 is a pictorial side view of one embodiment of the present invention of the zip track connected to towers or portions of a challenge course.
Figure 4B:
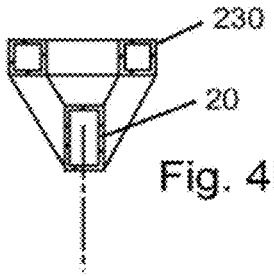
FIG. 4B is a pictorial cross sectional view of a portion of the zip track of FIG. 4.

FIG. 4 illustrates a zip track 20 extending from one challenge course 160 to another challenge course 160 wherein the support means 180 is a truss 230. The truss 230 may have two beams disposed above the zip track 20 connected to the zip track 20.

Support means 180 are not always necessary, but may be when the span of the zip track 20 is greater than a predetermined distance.

Figure 5:
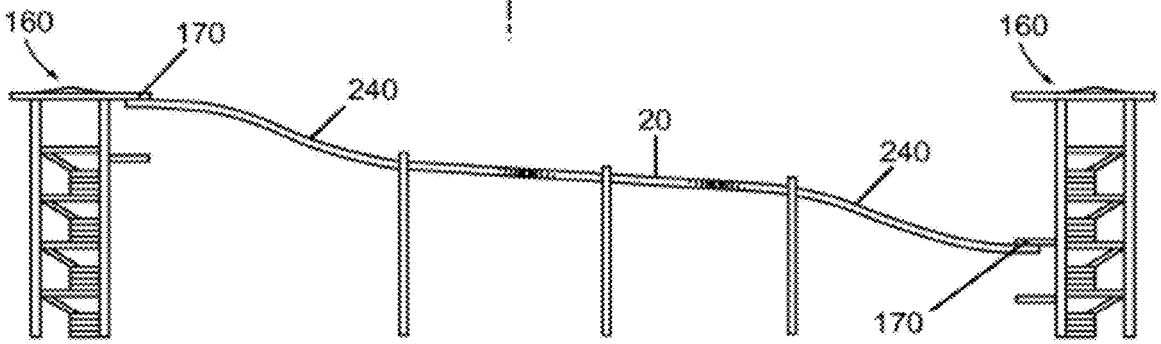
FIG. 5 is a pictorial side view of an embodiment of the present invention.

FIG. 5 illustrates an embodiment of the present invention 10 whereby the zip track 20 is not linear, but has a downward or upward curved portion 240. There may be more than one downward or upward curved portion 240. Here, the zip track 20 may have a non-linear slope.

Figure 6:
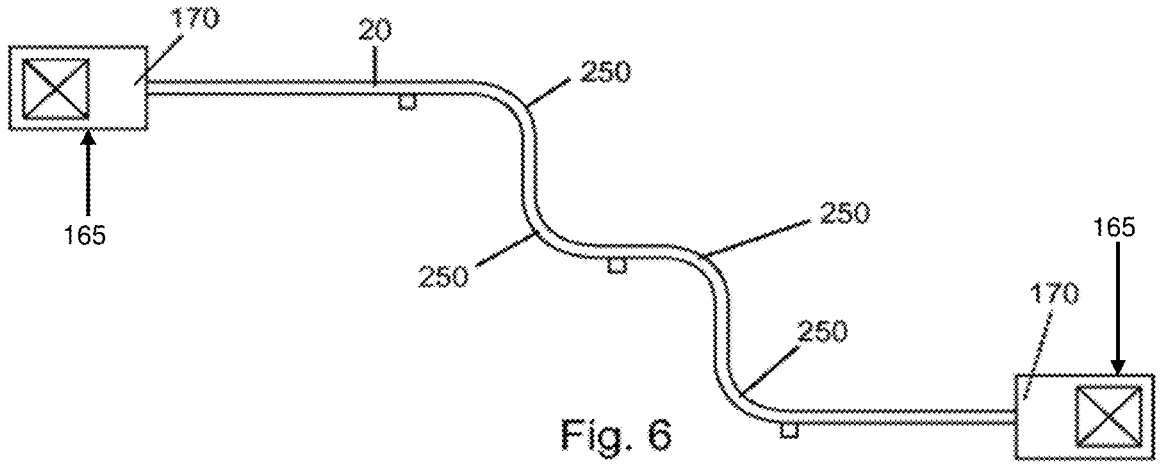
FIG. 6 is a pictorial top view of an embodiment of the present invention.

FIG. 6 illustrates a top view of an embodiment of the present invention 10 wherein the zip track 20 may have a leftward or rightward curved portion 250. In this embodiment, the zip track 20 curves at least one of either leftwardly or rightwardly.

Figure 7:
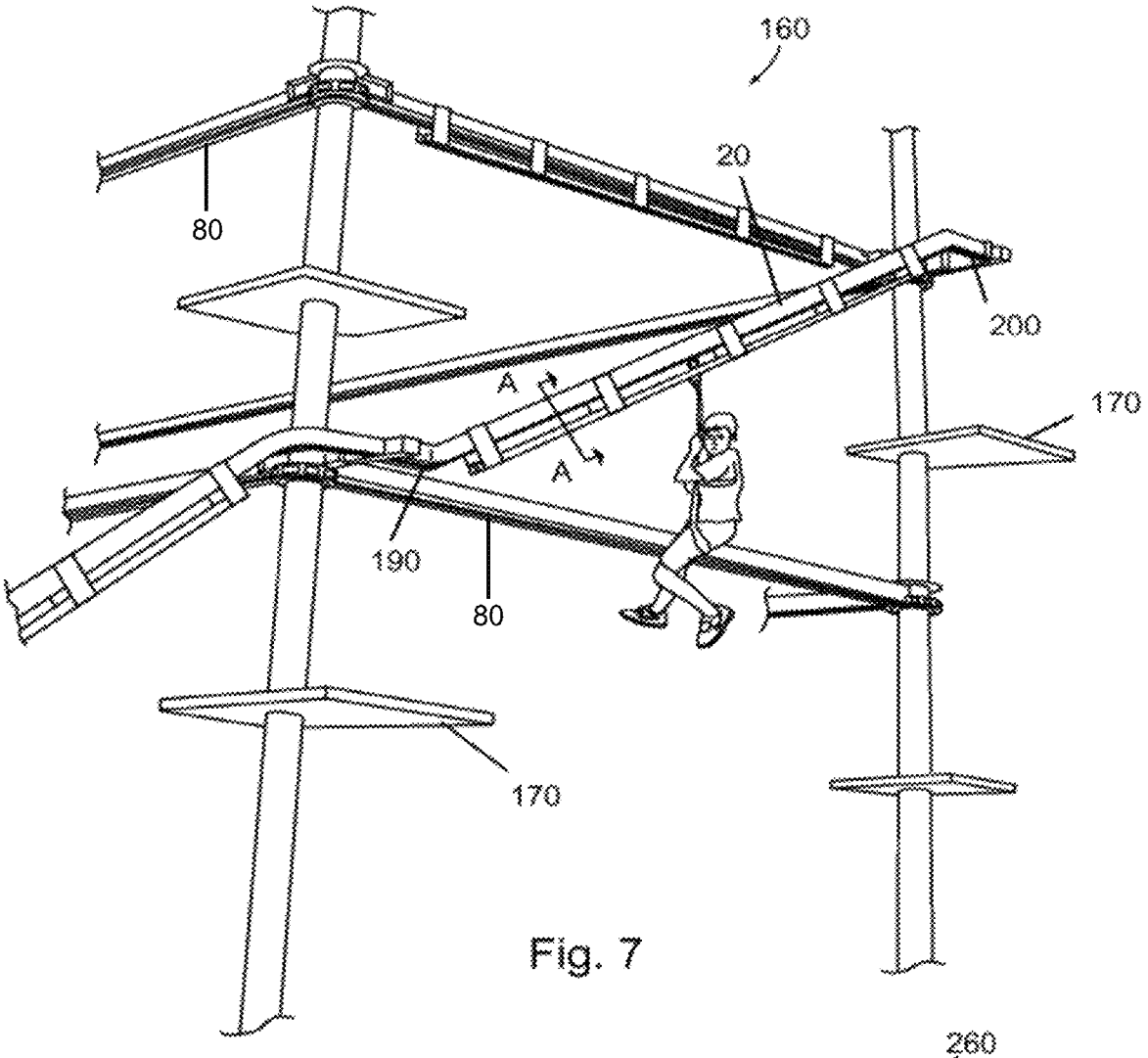
FIG. 7 is a pictorial view of a zip track connected to a challenge course, and as part of the element use of the challenge course.

FIG. 7 illustrates another embodiment whereby the zip track 20 has a higher end 200 and a lower end 190 on the same challenge course 160. The user may stand on a platform 170 before descending or after descending. In a further embodiment the zip track 20 may allow one to descend to exit the challenge course 160. In one embodiment the zip track 20 may be above an element of the challenge course 160.

Figure 8:
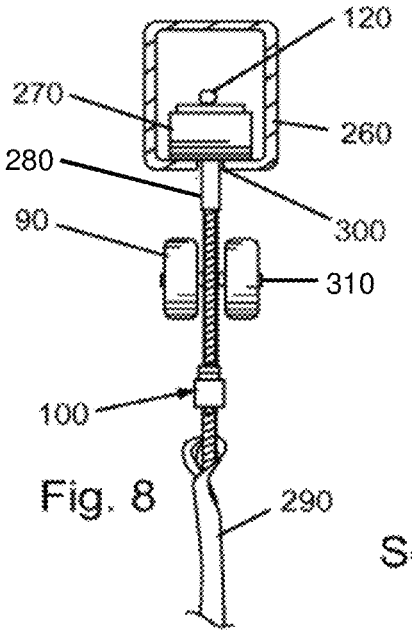
FIG. 8 is a pictorial view of an embodiment of the present invention showing a cross section of the puck track.
Figure 10:
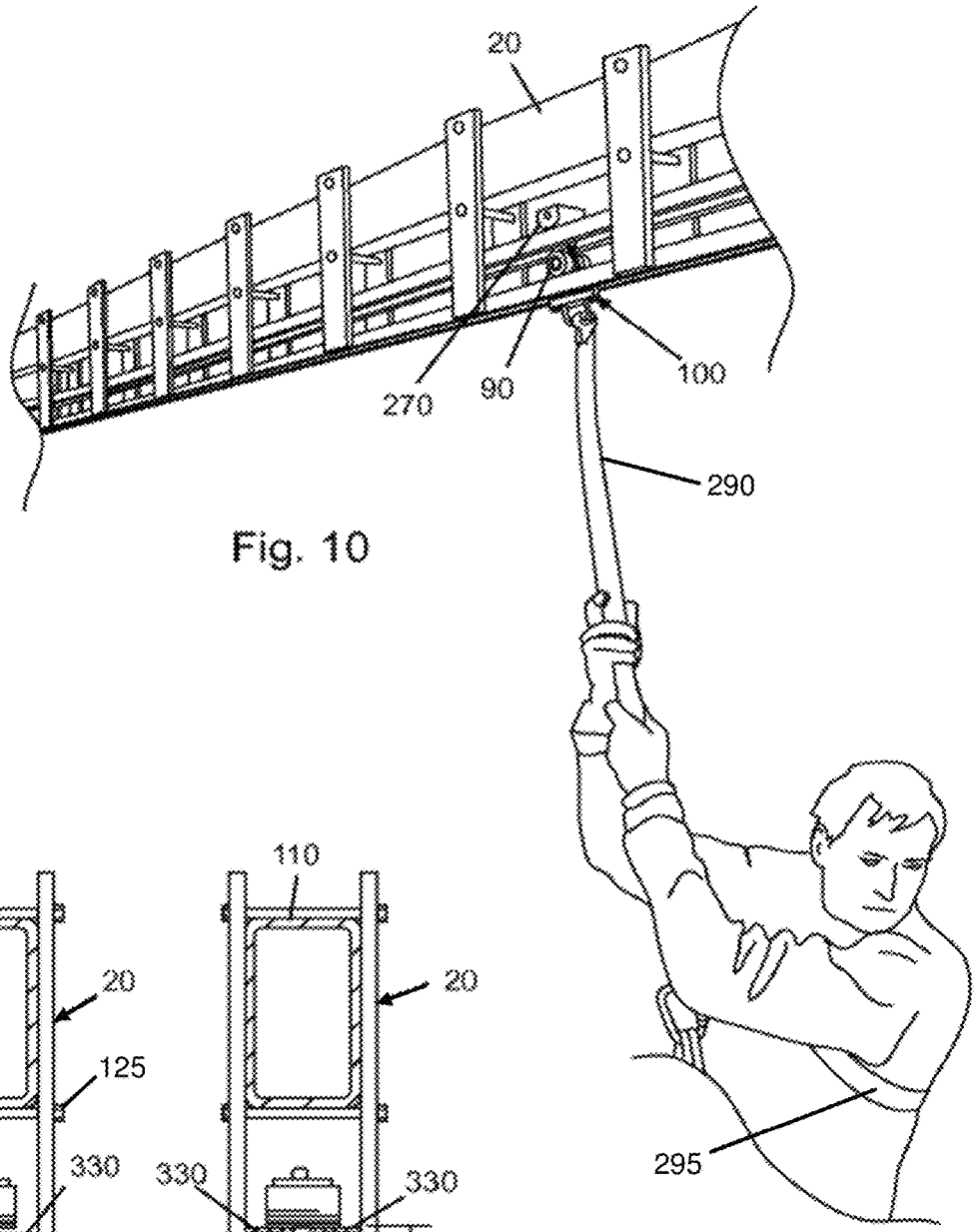
FIG. 10 is a pictorial view of a zip track of the present invention.
Figure 18:
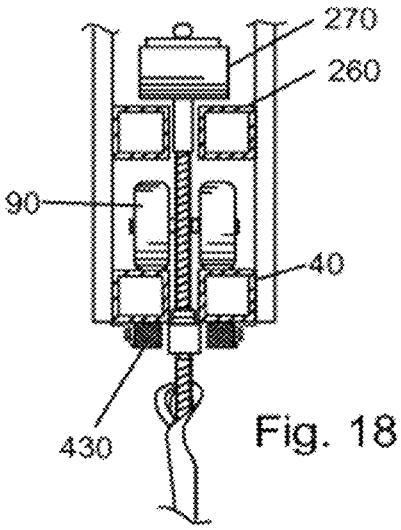
FIG. 18 is a pictorial sectional view of another embodiment of the present invention with the magnets below the wheel support.

FIG. 8 illustrates one embodiment of a body 100 that may have a body member 280 that can extend from a fastener 120 downwardly to a lanyard 290 connected to a safety harness 295 worn by a user (see FIGS. 10 and 18). A puck 270 may be secured to the body 100 so that the puck 270 can slide within a puck track 260. The puck track 260 may have a puck-track opening 300. The body 100 may extend downwardly from the fastener 120 through the puck-track opening 300. The puck track 260 may be used within the challenge course 160 when the zip track 20 is not used as a means to move about the challenge course 160.

A rotating member 90 may be rotatably secured to the body 100 downwardly from the puck 270. There may be two rotating members 90 rotatably secured to the body 100 via an axle 310. The rotating member 90 may be secured to the axle 310, and the axle may be rotatably secured to the body 100. Alternatively, the rotating member 90 may be rotatably secured to the axle 310, and the axle 310 may be rotatably or non-rotatably secured to the body 100.

Figure 9:
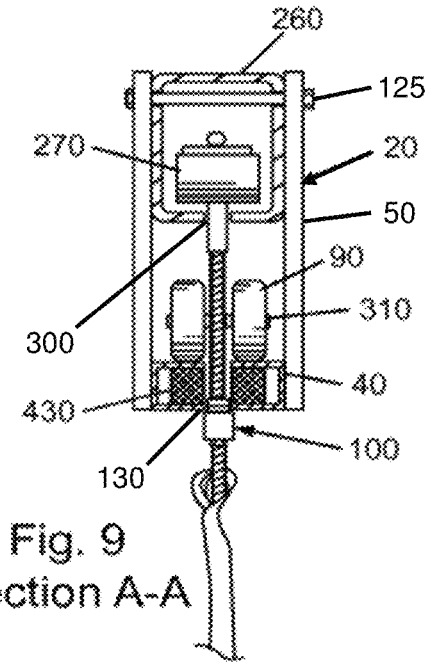
FIG. 9 is a pictorial cross sectional view of line A-A of FIG. 7.

As illustrated in FIG. 9, the zip track 20 may have a puck track 260 secured upwardly from a wheel support 40 so that the rotating member 90 can roll on the wheel support 40 to eliminate any downward force on the puck 270. The body 100 may extend through a zip track opening 130 which extends through the wheel support 40. This configuration of the zip track 20 can allow the body 100 to move from the puck track 260 to the zip track 20.

FIG. 10 illustrates an embodiment of the zip track 20 showing the body 100, the rotating member 90 and puck 270.

Figure 11:
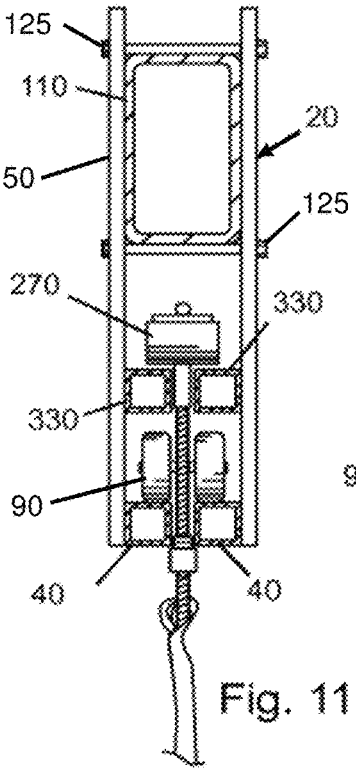
FIG. 11 is a pictorial sectional view of an embodiment of the present invention.

FIG. 11 illustrates an embodiment of the zip track 20 where the body 100 may be rolling along the rotating member 90 contacting the wheel support 40.

Figure 12:
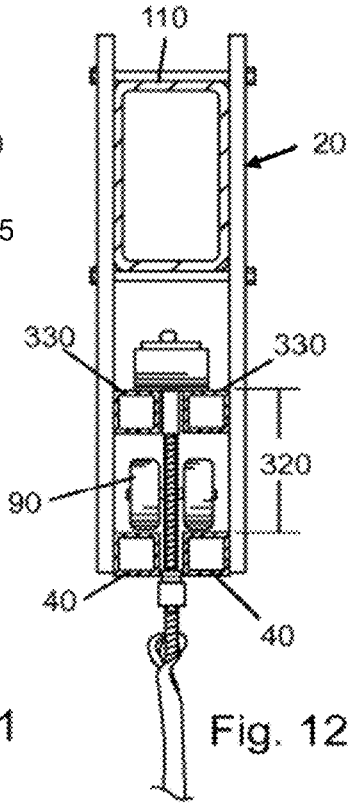
FIG. 12 is a pictorial sectional view of an embodiment of the present invention showing an embodiment of a braking means according to the present invention.

FIG. 12 illustrates an embodiment of the zip track 20 where the vertical distance 320 may be greater than a predetermined distance so that the puck 270 is in contact with a puck support 330, and the rotating member 90 is not in contact with the wheel support 40. This configuration allows the body 100 to slow down due to the friction between the puck 270 and the puck support 330. The zip track 20 may be connected to a frame 110. This is one example of the braking means 420 that may be utilized.

Figure 13:
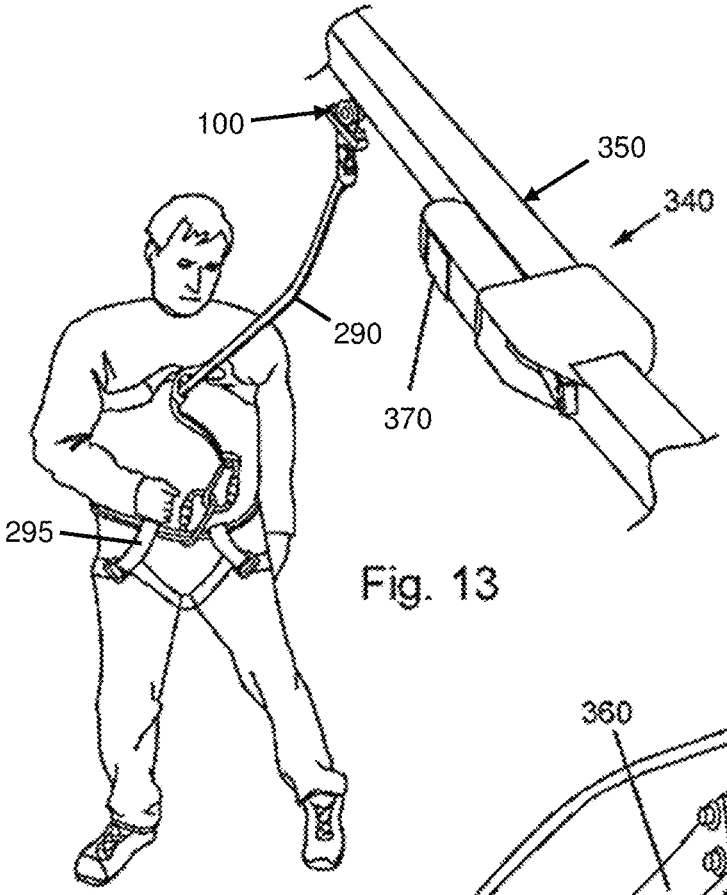
FIG. 13 is a pictorial view of an entrance zone of the present invention.
Figure 14:
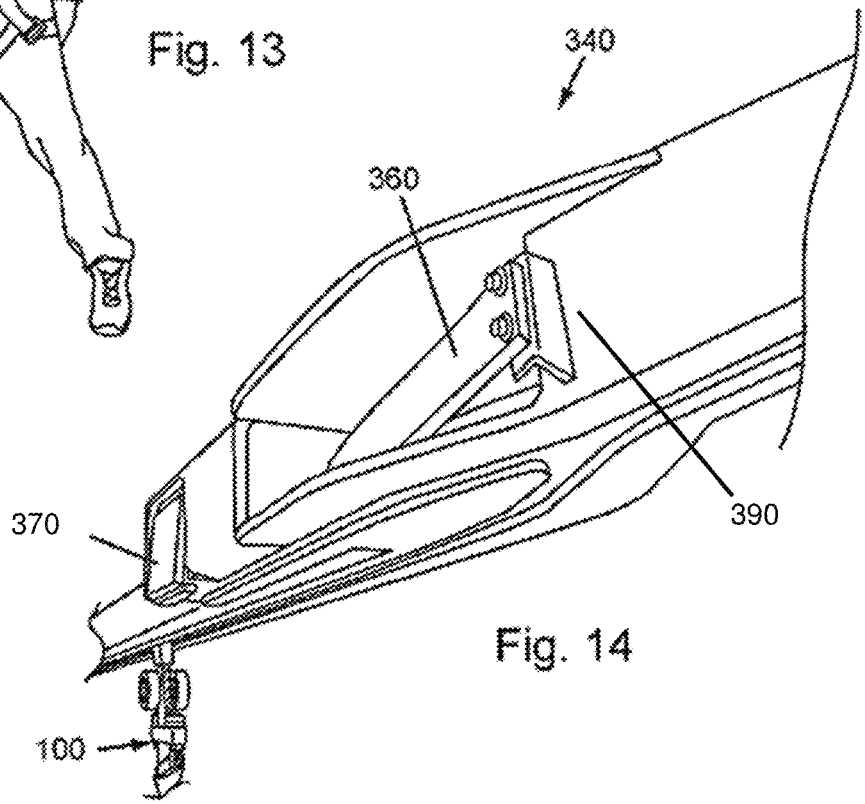
FIG. 14 is another pictorial view of the entrance zone of the present invention.

FIGS. 13 and 14 illustrate an embodiment of an exchange 340 of the present invention 10. The exchange 340 may have an entrance zone 350 where the body 100 may enter the challenge course 160 or zip track 20.

Figure 15:
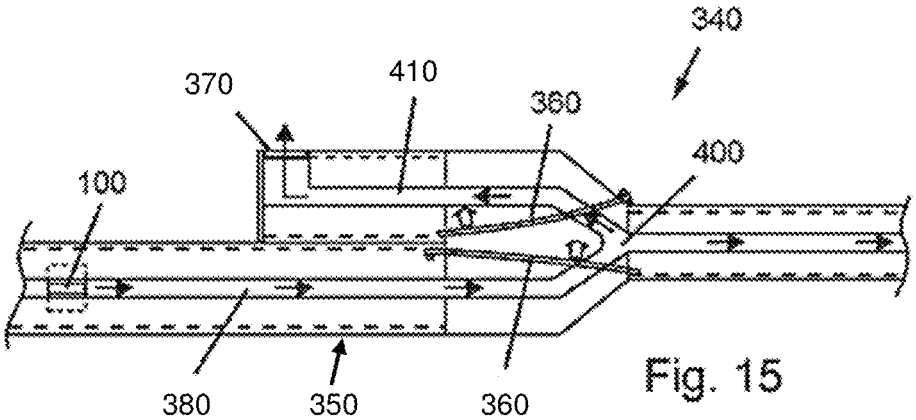
FIG. 15 is an internal pictorial top view of the entrance zone of the present invention.

As illustrated in FIG. 15, the body 100 may follow a path 380 away from the entrance zone 350 to an intersection 400. The intersection 400 may be a Y-shaped intersection that allows the user to continue to the challenge course 160, or the user can exit by taking the exit path 410, through a one way gate or back stop 360. The backstop 360 may be secured to the exchange 340 at a fixed side 390, and may bias to allow the body 100 to move through the path 380 in one direction, but not the opposite direction. To exit the exchange 340, the user would have to move the body 100 in the direction of the exit path 410, also having a one way gate 360.

Figure 16:
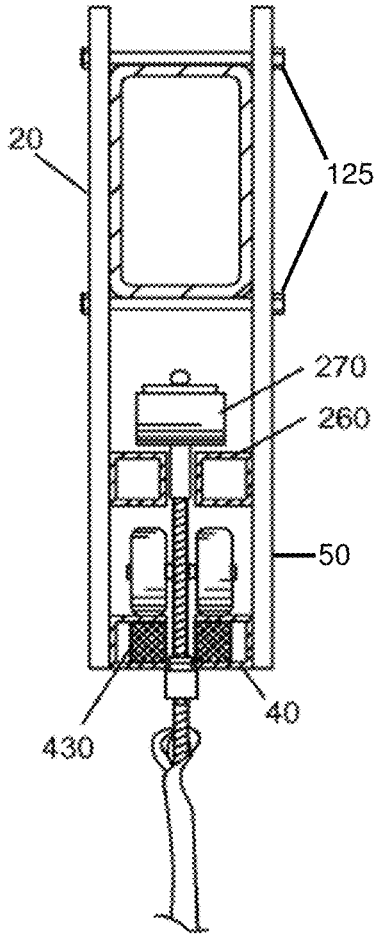
FIG. 16 is a pictorial sectional view of an embodiment of the present invention with the magnets in the wheel support.
Figure 19:
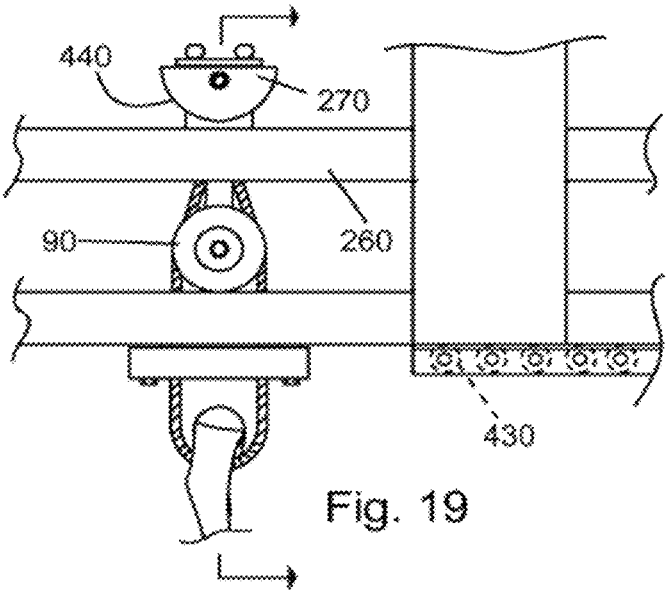
FIG. 19 is a pictorial view of a side view from FIG. 18.

FIGS. 16 and 18 illustrate embodiments of another braking means 420 that may be used in the zip track 20. In these embodiments, the zip track 20 may have a magnet 430 or a plurality of magnets 430 whereby when the body 100 is moving along the zip track 20, an eddy current is created to slow down the body 100, or to prevent the body 100 from obtaining an undesirable speed. In one embodiment the magnet 430 may be disposed within the wheel support 40 (see FIGS. 16 and 17). In another embodiment, the magnet 430 may be disposed below the wheel support 40 (see FIGS. 18 and 19). FIG. 16 also illustrates another embodiment of the puck track 260.

Figure 17:
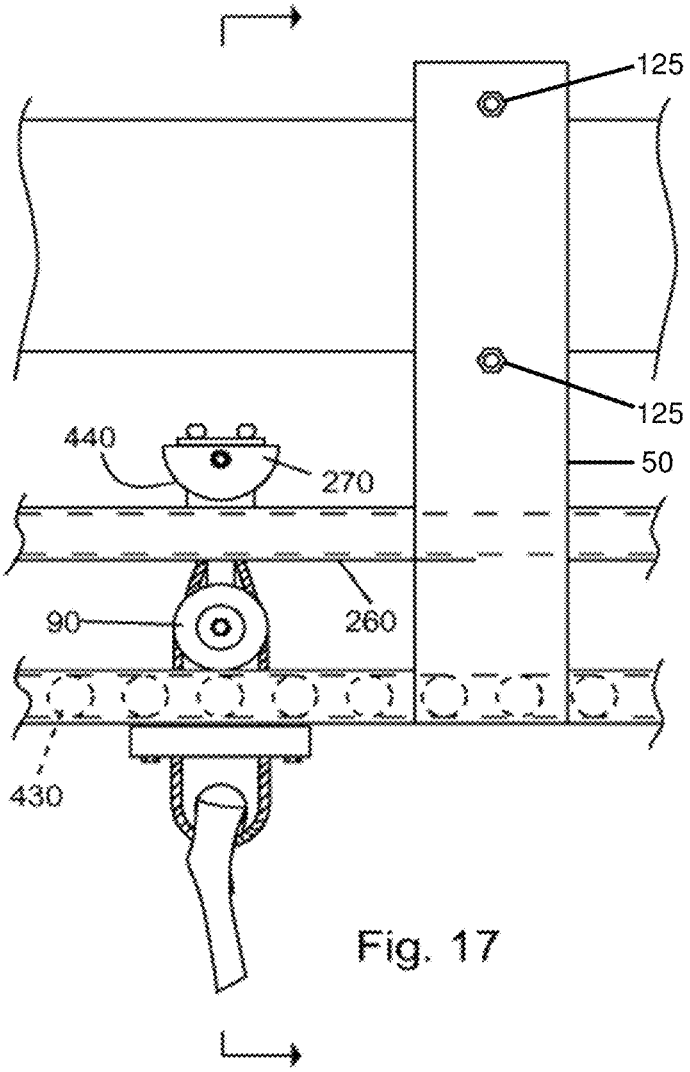
FIG. 17 is a pictorial view of a side view from FIG. 16.

FIG. 17 illustrates the side view of FIG. 16. FIG. 17 also illustrates one version of the puck 270 where the side profile may have a circular shaped surface 440.

The zip track system 10 may have a zip track 20 upon which the body 100 may be movably displaced as the rotating member 90 of the member 100 may move, become displaced, or roll relative to the zip track 20. The zip track 20 may be shaped to accommodate the shape of a rotating member 90. For example, the zip track 20 may have a wheel support 40 that allows the rotating member 90 to roll upon the wheel support 40 that may be disposed within the zip track 20.

The zip track 20 being secured to a frame 110 via one or more fasteners 125 (see FIGS. 9 and 11). In one embodiment the wheel support 40 may be secured to a plate 50.

The body 100 extending downwardly through the puck track opening 300, and downwardly through the zip track opening 130 (see FIG. 9).

Another embodiment includes a wheel support 40 without a rotating member 90 that still allows the member 100 to move, become displaced, or slide within the zip track 20 (not shown).

In one embodiment there are two rotating members 90 having a center to center distance substantially the same as the wheel support center to center distance (not shown).

The zip track 20 may be oriented with one end higher than the other, so that the user can slide down from the higher end 200 to the lower end 190, and then while traversing the other portions 80 of the challenge course 160, the member 100 moves with the challenge course track (see FIG. 7).

In another embodiment, the present invention 10 may have telescoping zip tracks 20 (not illustrated), which can extend outwardly for a longer zip track, or may retract inwardly for a shorter track.

It should be understood, of course, that the foregoing relates to exemplary embodiments of the invention and that modifications may be made without departing from the spirit and scope of the invention as set forth in the following claims.

The invention claimed is:

1. A course track system comprising:

a plurality of zip tracks, each zip track having a wheel support surface which extends from a higher end of the zip track to a lower end of the zip track, with the higher end arranged above one platform and the lower end arranged above another platform, a plurality of puck tracks connected to the zip tracks, each puck track having a puck support surface and a puck track opening which extends through the puck support surface, a moveable member displaceable along the puck tracks and the zip tracks, the moveable member comprising a puck and a rotating member, wherein the puck is disposed above the puck support surfaces when the moveable member is displaced along the puck tracks, and the rotating member is disposed above the wheel support surfaces when the moveable member is displaced along the zip tracks, wherein the lower end of one zip track is connected to the higher end of another zip track by a respective puck track extending therebetween.

2. The course track system of claim 1, wherein the puck tracks overlap with the zip tracks through at least a section thereof such that when the moveable member is moved into the higher end of each zip track, the puck of the moveable member is disposed above the puck support surface of the respective puck track and the rotating member is disposed above the wheel support surface of the respective zip track in the section.

3. The course track system of claim 1, wherein the rotating member is disposed downwardly from the puck on the moveable member.

4. The course track system of claim 1, wherein the wheel support surface has a zip track opening which extends therethrough.

5. The course track system of claim 4, wherein the moveable member includes a first wheel and a second wheel arranged on opposing sides of the moveable member, with the first wheel and the second wheel being disposed above the wheel support surface on opposite sides of the zip track opening when the moveable member is displaced along each zip track.

6. The course track system of claim 4, wherein the puck track opening and the zip track opening are vertically aligned.

7. The course track system of claim 1, wherein the zip tracks are attached to structures which support the platforms and the puck tracks connecting the zip tracks.

8. The course track system of claim 7, wherein the structures are challenge courses, towers, or a combination thereof.

9. The course track system of claim 1, wherein the lower ends of multiple zip tracks are connected to the higher ends of multiple zip tracks by respective puck tracks extending therebetween.

10. The course track system of claim 1, wherein the puck is lifted off the puck support surface when the rotating member is moved onto the wheel support surface at the first ends of the zip tracks.

11. The course track system of claim 1, wherein one or more zip tracks comprise a non-linear slope between the first and second ends thereof.

12. A course track system comprising:

a first structure supporting a first puck track, a second structure supporting a second puck track, a third structure supporting a third puck track, wherein each puck track has a puck support surface and a puck track opening which extends through the puck support surface, a first zip track with a higher end connected to the first puck track and a lower end connected to the second puck track, a second zip track with a higher end connected to the second puck track and a lower end connected to the third puck track, wherein each zip track has a wheel support surface which extends from the higher end to the lower end thereof, and a moveable member displaceable along the puck tracks and the zip tracks, the moveable member comprising a puck and a rotating member, wherein the puck is disposed above the puck support surfaces when the moveable member is displaced along the puck tracks, and the rotating member is disposed above the wheel support surfaces when the moveable member is displaced along the zip tracks, wherein the puck tracks overlap with the zip tracks through at least a section thereof such that when the moveable member is moved into the higher end of each zip track, the puck of the moveable member is disposed above the puck support surface of the respective puck track and the rotating member is disposed above the wheel support surface of the respective zip track in the section.

13. The course track system of claim 12, wherein the rotating member is disposed downwardly from the puck on the moveable member.

14. The course track system of claim 12, wherein each wheel support surface has a zip track opening which extends therethrough.

15. The course track system of claim 14, wherein the moveable member includes a first wheel and a second wheel arranged on opposing sides of the moveable member, with the first wheel and the second wheel being disposed above the wheel support surface on opposite sides of the zip track opening when the moveable member is displaced along each zip track.

16. The course track system of claim 14, wherein the puck track opening and the zip track opening are vertically aligned.

17. The course track system of claim 12, wherein the structures are challenge courses, towers, or a combination thereof.

18. The course track system of claim 12, wherein the structures support platforms underneath the ends of the zip tracks.

19. The course track system of claim 12, wherein the puck is lifted off the puck support surface when the rotating member is moved onto the wheel support surface at the first ends of the zip tracks.

20. The course track system of claim 12, wherein one or more zip tracks comprise a non-linear slope between the first and second ends thereof.

* * * * *